United States Patent [19]

Hoshizaki et al.

[11] Patent Number: 4,835,885

[45] Date of Patent: Jun. 6, 1989

[54] SKATE BOOT

[75] Inventors: Thomas B. Hoshizaki, Ville St. Pierre; Kenneth Hall, Pointe Claire; Rene Bourque, Duvernay, all of Canada

[73] Assignee: Warrington, Inc., Montreal, Canada

[21] Appl. No.: 11,529

[22] Filed: Feb. 6, 1987

[30] Foreign Application Priority Data

Dec. 29, 1986 [CA] Canada ..... 526377

[51] Int. Cl.[4] ..... A43B 5/16; A43B 23/26; A43B 13/38; A43C 11/00

[52] U.S. Cl. ..... 36/115; 36/43; 36/50; 36/58.5; 36/54; 128/611

[58] Field of Search ..... 36/115, 117, 43, 44, 36/50, 58.5, 128; 128/611

[56] References Cited

U.S. PATENT DOCUMENTS

| | | | |
|---|---|---|---|
| 806,267 | 12/1905 | King | 128/611 |
| 1,712,481 | 5/1929 | Ayers | 128/611 |
| 1,986,580 | 1/1935 | Johnson | 36/115 X |
| 2,088,851 | 8/1937 | Gantenbein | 36/50 |
| 2,211,057 | 8/1940 | Duckoff | 36/43 X |
| 2,563,763 | 8/1951 | Vietas | 36/89 X |
| 4,084,333 | 4/1978 | Del Vecchio | 36/43 |
| 4,509,276 | 4/1985 | Bourque | 36/115 |
| 4,616,432 | 10/1986 | Bunch et al. | 36/50 |

FOREIGN PATENT DOCUMENTS

| | | | |
|---|---|---|---|
| 1485627 | 3/1970 | Fed. Rep. of Germany | 36/115 |
| 1921508 | 10/1970 | Fed. Rep. of Germany | 36/54 |
| 3504363 | 8/1986 | Fed. Rep. of Germany | 36/44 |
| 207426 | 11/1923 | United Kingdom | 36/128 |
| 276816 | 9/1927 | United Kingdom | 128/611 |
| 1152212 | 5/1969 | United Kingdom | 36/58.5 |

*Primary Examiner*—James Kee Chi

*Attorney, Agent, or Firm*—Foley & Lardner, Schwartz, Jeffery, Schwaab, Mack, Blumenthal & Evans

[57] ABSTRACT

A skate boot is described which includes an overlapping tension strap extending from the medial side of the outer sole to the medial lacing band, and the lacing passes through eyelets provided in the tension strap. The lacing bands are arranged such that in the bottom portion thereof below the tarsis, they are symmetrical to a line drawn approximately over the highest ridge of the dorsal of the foot, that is, at the first or second metatarsal and above the tarsis they are symmetrical with the axis of the anterior tibial tendon so that the lacing is evenly distributed on either side of the highest ridge of the foot in these areas. A liner is provided in the rear part of the boot such as to provide lateral support. The liner is relatively stiff but is provided with cutouts allowing the boot to flex in the dorsal-plantar flexion direction.

8 Claims, 3 Drawing Sheets

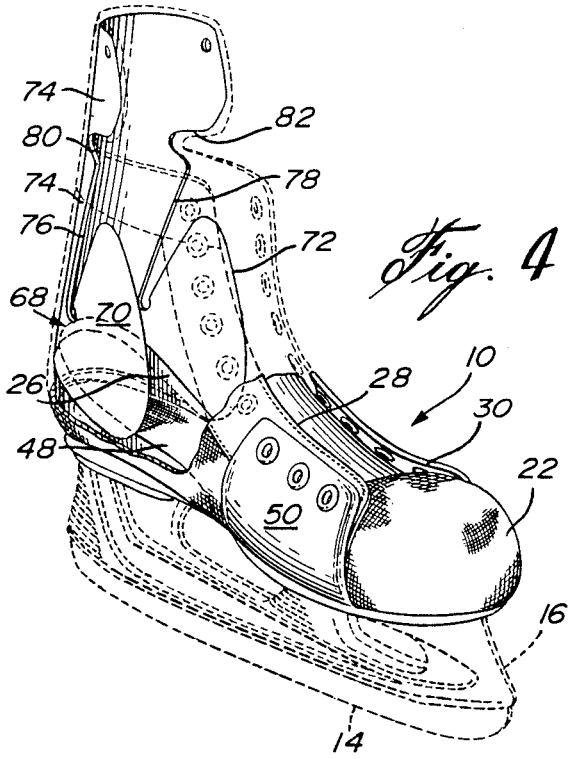
Fig. 4
Fig. 5
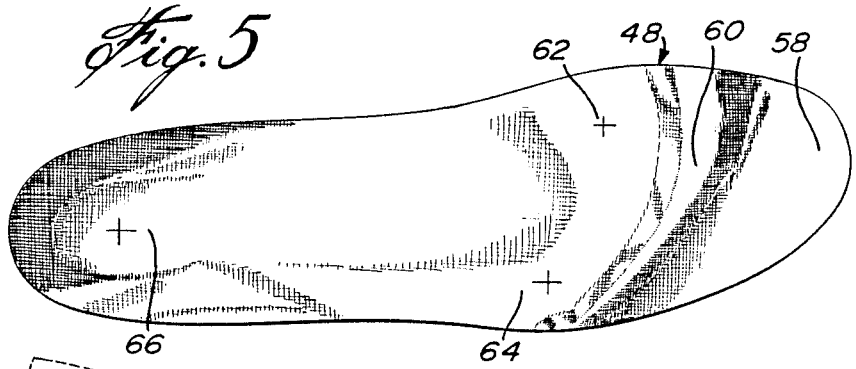
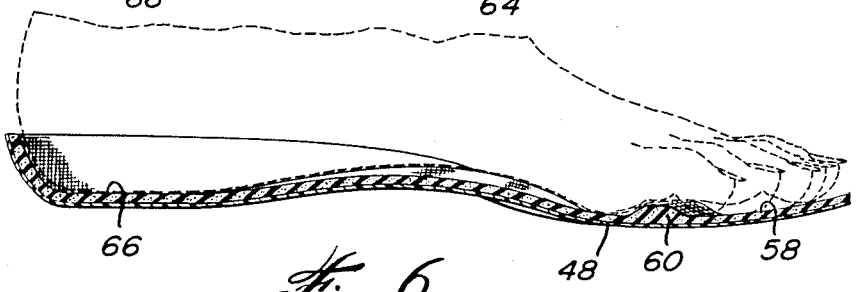
Fig. 6

SKATE BOOT

BACKGROUND OF THE INVENTION

1. Field of the Invention

The present invention relates to a skate boot and particularly to the construction of a skate boot for ice skating.

2. Description of the Prior Art

The design of conventional ice skates has been generally directed to making a skate boot safe, in the sense of protecting the foot, and comfortable. The developments which have been made in the area of protection include the provision of a rigid toe cap, achilles tendon guard and eventually the use of ballistic materials, such as woven nylon uppers. All of these improvements have served to protect the foot against the rough and tumble play in the sport of hockey and particularly the impact of a hockey puck, the slashing of a hockey stick and the slicing of a skate blade. In this regard, the ankle area of the boot has been padded and reinforced rendering the boot substantially rigid and resistant to the flexing of the foot in the supination-pronation sense as well as dorsal-plantar flexion of the foot about the ankle. A good deal of attention has been given to the comfort of the foot in a static, unflexed position of the foot without considering the dynamic conditions of the foot in the action of skating.

Molded plastic skate boots have also been developed with a view to reducing the cost of manufacturing a skate boot. The molded boot anticipates dorsal-plantar flexion by providing a two-piece boot with the cuff or upper-upper portion being hinged to the lower-upper at the level of the ankle. However, in most cases the remainder of the skate boot is rigid while providing a comfortable environment for the foot within the shell of the molded plastic boot in the form of an inner soft boot or slipper.

U.S. Pat. No. 4,509,276 issued Apr. 9, 1985, is directed to an improved partially molded boot which was designed with the above ergonomics in mind.

However, there does not appear to be a skate boot, particularly an ice skate boot, which takes into consideration the complete ergonomics of the foot during the skating movement.

For one thing, the foot is moving in a different direction, during skating, than the body. The skating action requires the feet to move alternately in lateral opposite directions relative to the longitudinal resultant direction of the body.

The foot and ankle include twenty-eight bones held by a strong but elastic system of ligaments. Ankle, foot and toe movements are produced by three groups of leg muscles and six groups of foot muscles.

Three actions dominate the complex skating pattern; these include flexing of the toes, flexion and extension of the ankle and a supination-pronation motion at the subtalar joint. During acceleration, the toes of the foot on which the weight is being shifted are flexed in order to secure the foot in the skate boot. The toes press against the inner sole, thus arching the foot so that the top of the foot presses against the tongue and presses the heel into the heel counter.

As pressure is applied to the foot, a pronation motion occurs followed by a supination during the foot extension during plantar flexion. This increases the reactive force applied to the body propelling it forward.

SUMMARY OF THE INVENTION

It is an aim of the present invention to provide an improved skate boot with lateral support to improve the foot support and provide a solid base against which the foot can press and to provide less but controlled resistance against pronation and supination.

It is a further aim of the present invention to provide a skate boot which provides less resistance against flexion of the foot about the ankle particularly during foot extension, that is, plantar flexion, as well as dorsal flexion, resulting in increased acceleration.

It is an aim of the present invention to provide a skate boot having an improved tongue designed to follow the natural contour .of the foot and to allow flexion motion of the foot about the ankle with reduced resistance.

It is a further aim of the present invention to provide a more efficient and effective distribution of the forces across the tongue.

It is a further aim of the present invention to provide a tensile strap means attached directly to the outer sole and to the lacing system in order to transfer the forces directly between the lacing system and the sole without these forces being diverted or dispensed.

A construction in accordance with the present invention comprises a skate boot having a sole and an upper fixed to the sole. A runner support mounting a linear runner is attached to the sole such that the linear runner is in a plane extending longitudinally, centrally and normally to the median plane of the sole. The sole includes a toe portion, a shank portion and a heel portion. The sole includes an inner edge at the juncture of the upper and sole and an outer edge on the other side of the upper. The upper includes a pair of eyelet band means defining the tongue opening. Lacing means are provided between the eyelet bands. A tension band is provided attached only at the inner edge of the sole and upper between the shank and toe portions and overlapping the respective upper wall to terminate at a respective eyelet band. The band has eyelet means to be engaged by the lacing means such that the tension band when engaged by said lacing will apply tension to said medial edge of the sole and thus to said runner when the skate boot is under compression by a foot during supination movement thereof with the foot pressing on the outer edge portion of the sole and simultaneously on the tongue means and lacing thereof during the skating pattern.

In a further embodiment of the above-mentioned skate an anatomical inner sole is provided within the skate boot such that a ridge is provided between the toes and the ball of the foot to provide a pressure ramp for the toes while the foot is arched in the skate boot, and the rear of the inner sole is sloped to the contour of the heel of the foot to provide a tight base therefor.

In another aspect of the present invention, there is provided a skate boot having a sole and an upper. The upper defines a pair of eyelet bands, spaced apart to form an elongated opening to accommodate the tongue. Tongue means are provided and lacing means extend from the inner eyelet band on the inner side of the boot to the outer eyelet band on the outer side of the boot. The eyelet bands are symmetrical to a longitudinal line drawn in an area including the first and second metatarsal bones of the foot below the talus and symmetrical to the longitudinal axis of the anterior tibial muscle above the talus such that when the foot is arched it presses against the tongue in an area containing the so-drawn line.

In another aspect of the present invention, there is provided a one-piece liner for a skate boot adapted to be located in the rear of the boot above the heel counter and including an upright portion overlying the achilles tendon and a pair of side members overlapping the ankle on either side of the upper. The liner includes a pair of slots open at the top and extending for a major part of the achilles tendon portion between the achilles tendon and the ankle portions. The one-piece liner is of relatively more rigid material than the material of the upper to reinforce the upper and protect the foot while allowing dorsal and plantar flexion due to the pair of slots.

In another aspect of the present invention, there is provided a tongue for a skate boot comprising a multi-layered member adapted to overlie the metatarsal and talus of the foot. The multi-layered tongue member comprises a lower soft resilient liner member adapted to be in contact with the foot and a pliable outer surface layer stitched along its edges to the lower layer forming an envelope therewith. A first base layer is located within the envelope being sufficiently rigid to provide a laterally bowed shape to the tongue but sufficiently flexible to allow dorsal and plantar flexion of the foot. A guard layer is provided within the envelope and overlying the base layer, the guard layer being of a material relatively more rigid than the base layer. The guard layer is laterally bowed relative to the base layer such that any pressure on the tongue from lacing will be transmitted to the guard layer which in turn will spread the pressure from the outer areas thereof to the base and form the tongue further to the contour of the foot.

BRIEF DESCRIPTION OF THE DRAWINGS

Having thus generally described the nature of the invention, particular reference will now be made to the accompanying drawings showing by way of illustration a preferred embodiment thereof wherein:

FIG. 4 is a perspective view partially cut away illustrating a further aspect of the present invention;

FIG. 5 is a top plan view of a detail shown in FIGS. 3 and 4;

FIG. 6 is a longitudinal cross section of the detail shown in FIG. 5;

DESCRIPTION OF THE PREFERRED EMBODIMENTS

Figure 1:
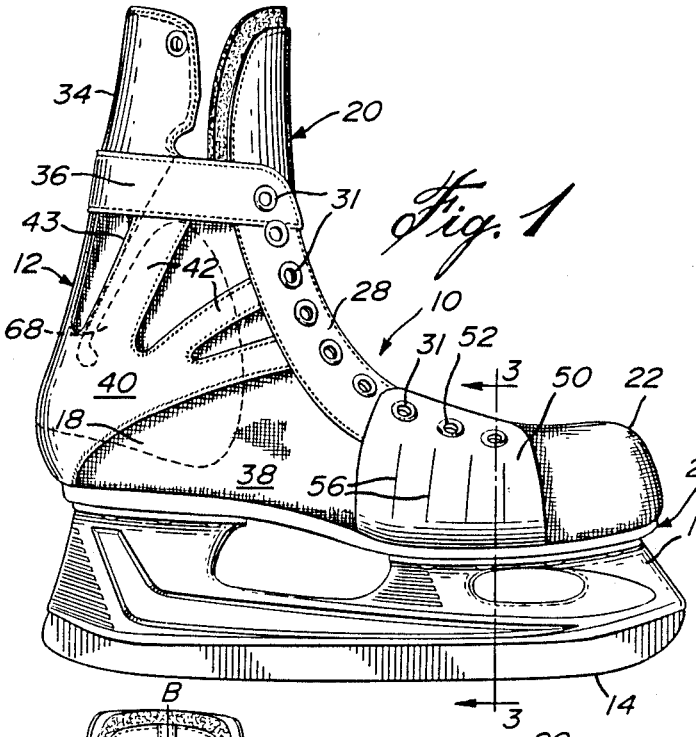
FIG. 1 is a side elevation of a skate boot incorporating the present invention.
Figure 2:
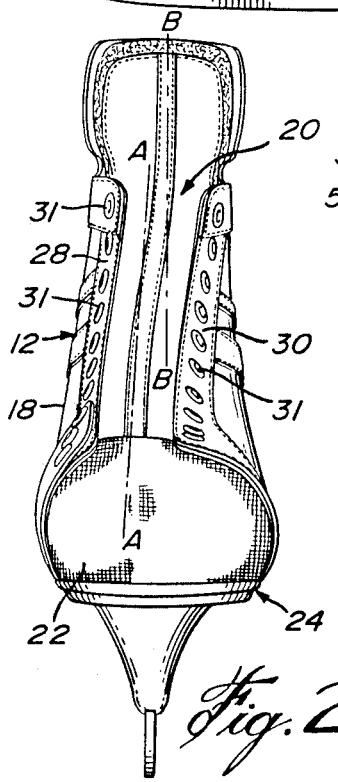
FIG. 2 is a front elevation thereof.
Figure 3:
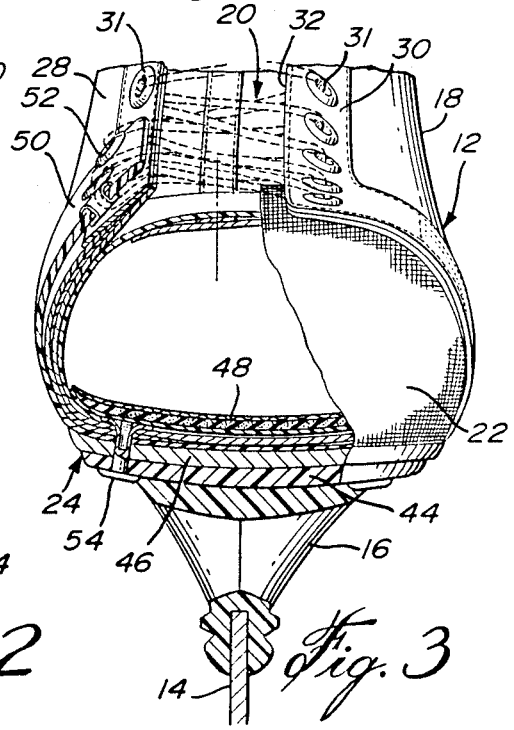
FIG. 3 is a fragmentary enlarged front elevation with a toe cap partially cut away showing a detail of the present invention.
Figure 7:
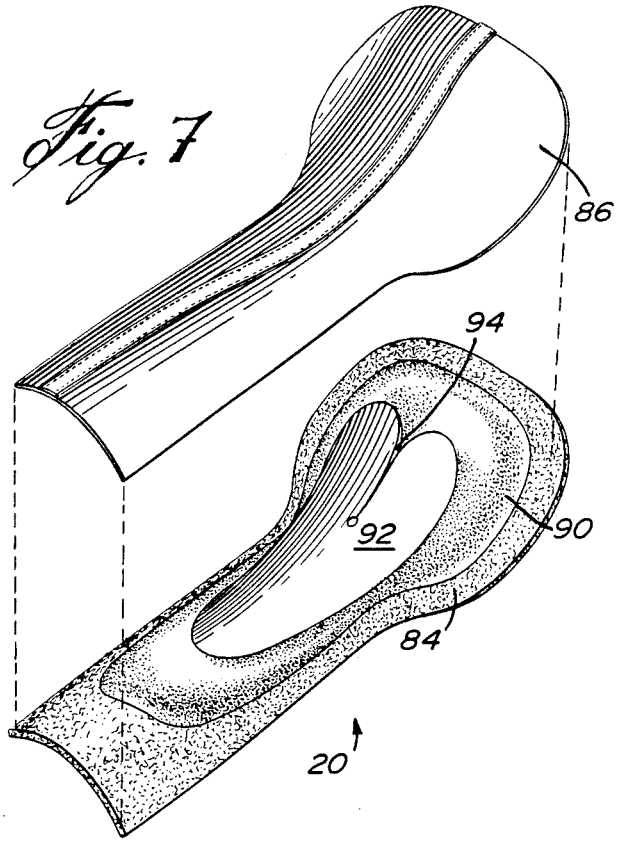
FIG. 7 is an exploded view of a further detail of the present invention.
Figure 8:
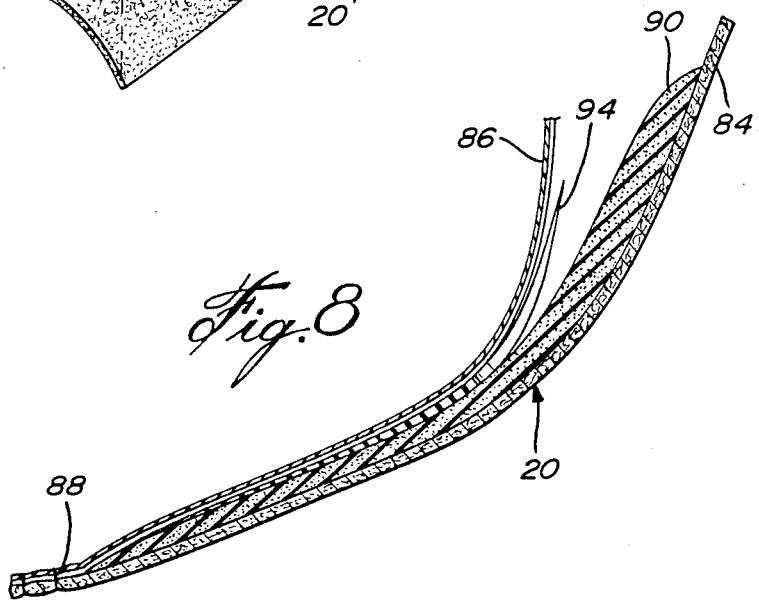
FIG. 8 is a longitudinal cross section of the detail shown in FIG. 7 partially disassembled.
Figure 9:
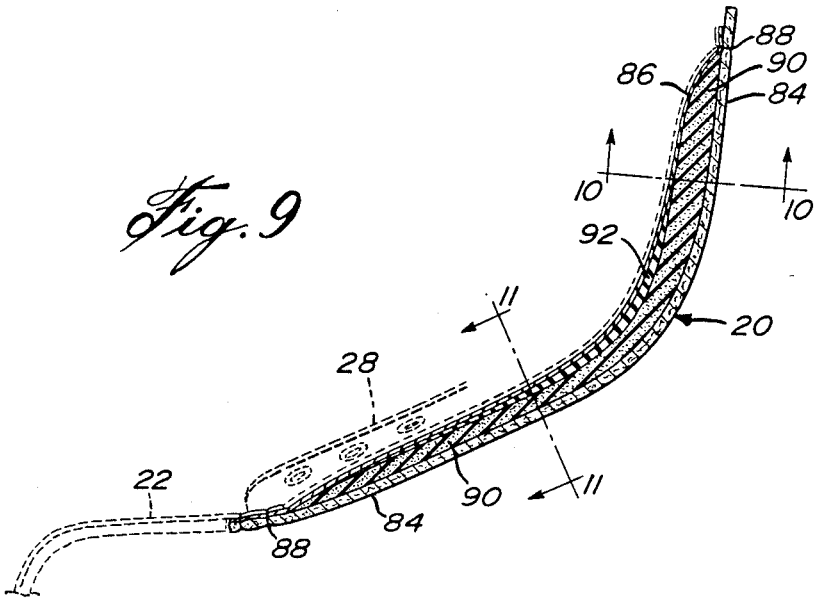
FIG. 9 is a longitudinal cross-sectional view of the detail shown in FIGS. 7 and 8.
Figure 10:
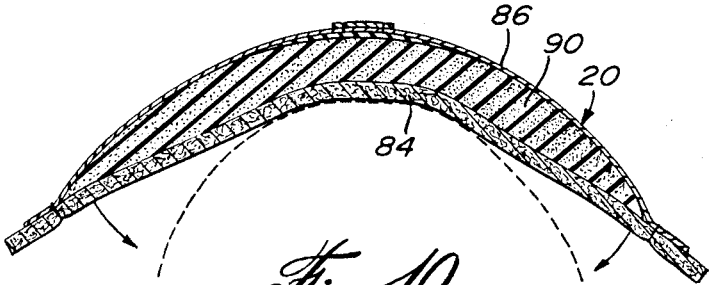
FIG. 10 is a lateral cross section taken along lines 10—10 in FIG. 9.

Referring now to the drawings, there is shown in FIGS. 1 and 2 a skate 10 comprising a skate boot 12 a hockey skate blade 14 held in a molded support 16 which is attached to the skate boot 12.

The skate boot 12 includes an upper 18 to which is fixed a sole 24. The upper includes a toe cap 22, a heel counter 26, a pair of eyelet bands 28 and 30. The eyelet bands 28 and 30 define between them an opening 32 through which can be seen the tongue 20. The skate boot 12 also includes an upwardly projecting tendon guard 34 extending upwardly from a cuff 36. The upper 18 of the present boot is a conventional last-mounted upper. The material forming the upper, including the toe cap and side walls, is a ballistic woven material such as nylon. Portions of the upper are covered by a leather or the like layer 40 such as covering the heel counter with fingers 42 extending towards the cuff 36 and eyelet bands 28 and 30.

The eyelet bands 28 and 30, as shown in FIG. 2, may appear to be asymmetric. In fact, the eyelet bands have been designed in the lower part of the foot, that is below the talus, the first and second metatarsal bones representing the portion of the foot which is the highest. The foot tapers downwardly towards the fifth metatarsal from approximately the second metatarsal. The line A—A is drawn over the highest ridge of the foot, that is roughly over the first and second metatarsals. The eyelet bands in the area below the talus will be found to be symmetrical on either side of this line A—A. Likewise, above the talus and ankle area, it is the anterior tibial tendon which projects forward the furthest so that if a line B—B is drawn, which is roughly the axis of the anterior tibial, it will be found that the eyelet bands 28 and 30 in the area above the talus are symmetrical to this line B—B. The eyelet bands of course curve from one symmetrical pattern to the other in the transitional zone at the talus level.

A tension band 50 is located on the innermost side of the skate boot and is securely attached by rivets 54 to the edge of the outer sole 46 by means of rivet 54. Rivet 54 in fact passes through the platform 44 and skate blade support 16 to securely fasten the lower edge of the tension band 50. The upper edge of the tension band is provided with eyelets 52 which correspond roughly with the level of the eyelet band 28. Finally, slits 56 are provided in the band 50 running parallel to the direction of forces applied to the band 50. Lacings, as shown in dotted lines, extend between the eyelets 31 from one eyelet band 28 to the other eyelet band 30 with the exception that in a lower portion of the boot the lacings on the eyelet band 28 side lace through eyelets 52 in the tension band 50 and not through eyelets 31. The tension band 50 is provided in the area of the ball of the foot ahead of the shank and behind the toe cap 22.

The purpose of this construction, that is its symmetrical arrangement of the eyelet bands 28 and 30 and the provision of a tension band 50, will now be described.

As previously mentioned, the foot during the acceleration cycle of a skating pattern is projected sideways from the body with the other side of the foot facing forward. The foot which is within the skate boot 12 is a few inches above the ice surface balanced on the blade 14. The blade 14 has edges and as the foot is pressed against the inner edge of blade 14 the foot will be arched by pressing the toes downwardly against the inner sole 48 causing the heel of the foot to press down in the heel section 66 of the inner sole 48 as will be described later. The metatarsal area of the foot will arch upwardly pressing against the underside of the tongue 20 and thus against the lacing. The foot during the acceleration cycle will first undergo pronation and then supination and the pressure will be on the ball of the foot on the inner side of the skate to press the blade into the ice and engage the inner edge of the blade and the pressure will then shift as the foot rotates inwardly so that the outer edge of the foot presses down on the lateral edge of the inner sole to provide maximum purchase in the leverage system between the sole 24 and the blade in the leverage system between the sole 24 and the blade 14 against the ice surface. The tension band 50 maintains tension between the medial edge of the sole 24 and thus the blade support and blade and the lacing which has been pressed upwardly by the arching of the foot. Without the tension band 50, efficiency would be lost by the actual deformation and stretching of the inner side wall of the upper.

The inner sole 48, which is a well-known product, is used with advantage in the present dynamic system as the inner sole 48 includes a toe area 58, a ridge 60 serving as a ramp for the toes of the foot. Behind the ridge 60 are support areas 62 and 64 for the ball of the foot and the other side of the foot, respectively, and a heel support 66 which in part is a tight fitting socket for the heel. As the foot arches upwardly the toes press against the ramp formed by the ridge 60 and the heel digs into the heel support area 66. The inner sole 48 maintains comfort of the foot and enhances the transmission of forces from the foot to the boot, as described above.

Referring now to FIG. 4, the upper 18 of the skate boot is cut away to show liner 68. Liner 68 is made of a stiff plastics material to provide an achilles tendon guard 74 which extends from the portion overlapping the heel counter to the upper extremity of the tendon guard 34. Likewise, a pair of ankle guards 70 and 72 project from the achilles tendon guard 74 defining slots 76 and 78 therebetween. Slots 80 and 82 are also provided between the bottom part of the achilles tendon guard 74 and the upper part thereof. The slots are provided to allow also plantar flexion of the foot about the ankle, that is front and rear flexing of the leg relative to the foot. The slots 80 and 82 for instance allow the tendon guard 34 to flex rearwardly under pressure of the foot extension or plantar flexion phase. The purpose of the ankle guards 70 and 72, therefore, is to provide lateral support to the boot. The leather or the like layer 40 is stitched through to liner 68. The opening 43 of layer 40 between fingers 42 coincides with the slots 76 and 78. The forward fingers 42 are stitched to the ankle guards 70 and 72 to provide lateral support.

Figure 11:
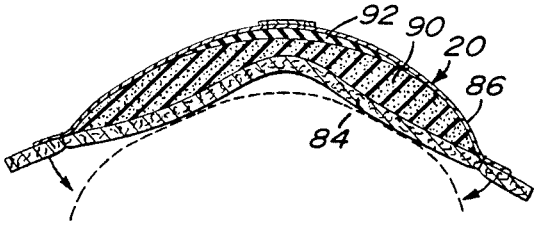
FIG. 11 is a lateral cross section taken along lines 11—11 of FIG. 9.

As seen in FIGS. 7 to 11, the tongue of the skate has a distinctive construction. A conventional inner liner 84 and leather or the like cover 86 stitched at 88 about the periphery thereof is provided. However, within the sandwich created by the inner liner 84 in the cover 86 two elements are inserted including a base layer 90 of semi-rigid material, such as a molded closed cell polyurethane foam, having a preformed bowing or curve in the lateral direction and a stiff layer 92 sits on top of a base 90. The layer 92, which is of a stiffer construction than base 90, is also bowed in the lateral direction but is more exaggerated, i.e. the radius of the curve is smaller than the radius of the normal curve of the base 90. The layer 92 is made of rigid thermoplastic material. The layer 92 includes a longitudinal slot 94 which allows flexion of the tongue, particularly in the dorsal-plantar direction without causing the stiff material of the layer 92 to yield as well as to allow other flexing movement of the foot. The layer 92 serves to distribute the pressure of the lacing in a more uniform manner on the base 90 and against the inner layer 84. For instance, as shown in FIG. 11, the layer 92 will bridge the first metatarsal area, distributing the pressure to the outer areas of the layer 92 on either side of the ridge caused by the first metatarsal. The guard layer 92 also protects the foot from cuts or impacts which can occur during the game of hockey. Likewise, when the foot is arched against the tongue 20, the force transmitted by the arch against the lacing would be more evenly distributed. The preform of the layer 92 and base layer 90 will also cause the tongue to assume a more contoured form against the foot as pressure of the lacing is applied.

We claim:

1. A skate boot comprising a sole and an upper fixed to the sole, a runner support mounting a linear runner attached to the sole such that the linear runner is in a plane extending longitudinally, centrally and normally to the median plane of the sole, the sole including a toe portion, a shank portion and a heel portion, the sole including a medial edge at the juncture of the upper and sole and a lateral edge on the other side of the upper, the upper including a pair of eyelet band means defining a tongue opening, lacing means between the eyelet bands, tongue means extending between the eyelet bands covered by the lacing means, a single tension band attached only at the medial edge between the shank and toe portions in the area of the ball of the foot and overlapping the corresponding upper wall to terminate at the corresponding eyelet band, the tension band having eyelet means to be engaged by the lacing means such that the lacing means extends between the eyelet means on the tension band and eyelet band on the lateral upper wall whereby the tension band when engaged by said lacing will apply tension to said medial edge of the sole and thus to said runner when the skate boot is under compression by a foot during supination motion thereof with the foot pressing on the lateral edge portion of the sole and simultaneously on the tongue means and lacing thereof during the skating pattern.

2. A skate boot as defined in claim 1, wherein an anatomical inner sole is provided within the skate boot on said sole, the inner sole having a ridge provided between the toes and the ball of the foot to provide a pressure ramp for the toes while the foot is arched in the skate boot, the rear of the inner sole being sloped to the contour of the heel of the foot to provide a tight-fitting base for the heel of the foot.

3. A skate boot as defined in claim 1, comprising a one-piece liner located in the rear of the boot at least above the heel counter and including an upright portion overlying the achilles tendon area and a pair of side members overlapping the ankle area on either side of the upper, the liner including a pair of slots opened at the top thereof and extending for a major extent of the achilles tendon portion between the achilles tendon and the ankle portions, the one-piece liner being of material relatively stiffer than the material of the upper in order to reinforce the upper and protect the foot and whereby the slots thereof permit dorsal and plantar flexion of the foot when in the boot.

4. A one-piece liner as defined in claim 3, wherein horizontal slots are provided between the achilles tendon guard extension and the achilles tendon guard portion to enhance the dorsal-plantar flexion of the foot.

5. A skate boot as defined in claim 1, wherein the tension band includes a plurality of parallel slits in the direction of the tension forces, dividing the single tension band into a plurality of sub-band portions extending from the medial edge to locations near the eyelet means on the tension band.

6. A skate boot having a sole and an upper, the upper defining a pair of eyelet bands spaced apart to form an elongated opening to accommodate a tongue, tongue means, lacing means extending from the inner eyelet band on the inner side of the boot to the outer eyelet band on the outer side of the boot, the eyelet bands being symmetrical to a longitudinal line drawn in an area including the first and second metatarsal bones of the foot below the talus and symmetrical to the longitudinal axis of the anterior tibial muscle above the talus such that when the foot is arched it presses against the tongue in an area containing the so-drawn line.

7. A skate boot as defined in claim 6, wherein the tongue means includes a multi-layered member for overlying the metatarsal and talus of the foot, the multi-layered tongue member comprising a lower soft resilient layer member adapted to be in contact with the foot and a pliable outer surface layer stitched along its edges to the lower layer for forming an envelope therewith, a first base layer located within the envelope and being sufficiently rigid to provide a laterally bowed shape to the tongue but sufficiently flexible to allow dorsal and plantar flexion of the foot, a guard layer within the envelope and overlying the base layer, the guard layer being of material relatively more rigid than the base layer, the guard layer being laterally bowed relative to the base layer such that any pressure on the tongue from the lacing means will be transmitted to the guard layer which in turn will distribute the pressure on the surface of the base and conform the tongue further to the contour of the foot.

8. A tongue member as defined in claim 7, wherein the radius of the guard layer is smaller than the radius of the base in the lateral extend such that the guard member when pressure is applied will further bow the base member to form the contour of the foot.

* * * * *